US008157475B2

(12) United States Patent
Kim et al.

(10) Patent No.: US 8,157,475 B2
(45) Date of Patent: Apr. 17, 2012

(54) REINFORCEMENT LINER INSTALLATION MOLD MOUNTED ON A CORRUGATED STEEL PLATE STRUCTURE

(75) Inventors: Hyeon-Kuk Kim, Jeollanam-do (KR); Byung-Gun Jung, Gyeonggi-do (KR); Seung-Ho Kim, Gyeonggi-do (KR)

(73) Assignee: Fixon E&C Co., Ltd., Seoul (KR)

( * ) Notice: Subject to any disclaimer, the term of this patent is extended or adjusted under 35 U.S.C. 154(b) by 937 days.

(21) Appl. No.: 12/094,550

(22) PCT Filed: Jan. 6, 2006

(86) PCT No.: PCT/KR2006/000055

§ 371 (c)(1),
(2), (4) Date: Jun. 5, 2008

(87) PCT Pub. No.: WO2007/073017

PCT Pub. Date: Jun. 28, 2007

(65) Prior Publication Data

US 2008/0298903 A1 Dec. 4, 2008

(30) Foreign Application Priority Data

Dec. 20, 2005 (KR) ..... 10-2005-0126288

(51) Int. Cl.
*E02B 13/02* (2006.01)
*E04C 2/32* (2006.01)

(52) U.S. Cl. ..... 405/49; 52/783.11

(58) Field of Classification Search ..... 405/45, 405/46, 49; 52/783.11
See application file for complete search history.

(56) References Cited

U.S. PATENT DOCUMENTS

| | | | | |
|---|---|---|---|---|
| 1,999,500 | A * | 4/1935 | Carswell et al. | 405/124 |
| 2,062,706 | A * | 12/1936 | Freeze et al. | 405/153 |
| 2,114,834 | A * | 4/1938 | Foukal | 405/153 |
| 3,687,768 | A * | 8/1972 | Vaitses et al. | 156/212 |
| 4,318,635 | A * | 3/1982 | Gurtner et al. | 405/126 |
| 4,796,393 | A * | 1/1989 | Toti | 52/76 |
| 5,233,799 | A * | 8/1993 | Abukawa | 52/86 |
| 5,326,191 | A | 7/1994 | Wilson | |
| 5,833,394 | A * | 11/1998 | McCavour | 405/126 |
| 6,474,907 | B2 * | 11/2002 | Semotiuk et al. | 405/126 |
| 6,596,722 | B2 * | 7/2003 | Moltzen et al. | 514/252.13 |
| 2002/0076280 | A1 * | 6/2002 | Semotiuk et al. | 405/124 |
| 2003/0143028 | A1 * | 7/2003 | Wilson | 405/124 |
| 2009/0214297 | A1 * | 8/2009 | Wilson | 405/124 |

FOREIGN PATENT DOCUMENTS

| | | | |
|---|---|---|---|
| KR | 10-2003-0030608 | A | 4/2003 |
| KR | 10-2003-0053637 | A | 7/2003 |

* cited by examiner

*Primary Examiner* — Michael Safavi
(74) *Attorney, Agent, or Firm* — Levine & Mandelbaum

(57) ABSTRACT

The present invention relates to a reinforcement liner installation mold for a corrugated steel plate structure. The reinforcement liner installation mold for the corrugated steel plate structure according to the present invention is mounted on one surface of a corrugated steel plate and forms a reinforcement liner when concrete is placed inside the mold the placed concrete cures. The mold includes a plurality of unit mold panels, each having a rectangular front panel part and two side panel parts integrally formed along the opposite lengthwise edges of the front panel part. The plurality of unit mold panels is sequentially fastened to the corrugated steel plate by a plurality of anchor bolts and a plurality of nuts along the outer surface of the corrugated steel plate in a lengthwise direction.

4 Claims, 4 Drawing Sheets

REINFORCEMENT LINER INSTALLATION MOLD MOUNTED ON A CORRUGATED STEEL PLATE STRUCTURE

TECHNICAL FIELD

The present invention relates, in general, to a reinforcement liner installation mold for a corrugated steel plate structure and, more particularly, to a reinforcement liner installation mold for the corrugated steel plate structure, which comprises a plurality of unit mold panels removably attached along the outer surface of a corrugated steel plate using anchor bolts and nuts, so that the period of time required for mounting and removing the mold to and from the surface of the corrugated steel plate during a process of placing and curing concrete to make a reinforcement liner can be reduced, and work efficiency or the amount of work that is done can be increased, and, furthermore, the removed molds can be reused.

BACKGROUND ART

Generally, to fabricate a corrugated steel plate structure, which has been variously used as a material of an underground passage, an irrigation channel, a drain, an embankment cell, a bank revetment drain, a roof, or a warehouse, a plurality of steel plates having predetermined thickness and width are bent and formed into various shapes, and are assembled with each other in an axial direction to form a tunnel shape.

When the size of a desired corrugated steel plate structure is small, one corrugated steel plate which has been subjected to a bending process may be used. However, when the size of a desired corrugated steel plate structure increases, a plurality of corrugated steel plates, which have been separately subjected to respective bending processes with high bending ratios, are used such that the steel plates overlap and are assembled with each other through an assembly process, such as a bolting process, at the construction site, thus producing a desired structure.

Further, in an effort to increase the load carrying capacity of a thin steel plate by evenly distributing a load or shock, which is applied to the thin steel plate in a side direction, a latitudinal direction, a longitudinal direction or any direction, to surrounding areas, the thin steel plate is preferably subjected to a crimping process, thus forming a corrugated steel plate having alternating furrows and ridges.

To construct a structure using the above mentioned corrugated steel plates, the ground on which the structure is supported is dug to a predetermined depth for laying the foundation. After laying the foundation, molds and reinforcing bars are arranged. Thereafter, anchors and a channel are laid, and concrete is placed prior to curing the concrete. After the concrete has been completely cured, the molds are removed from the channel.

After removing the molds from the channel, a plurality of first corrugated steel plates is fixed in the channel using locking members, such as bolts and nuts, such that the lower ends of the first steel plates are perpendicular to the channel. Thereafter, second corrugated steel plates are bolted to the first corrugated steel plates at locations between the first corrugated steel plates, thus forming a desired corrugated steel plate structure.

However, the conventional corrugated steel plate, constituting the corrugated steel plate structure, is produced through a crimping process, in which a thin steel plate is crimped to form alternating furrows and ridges that extend parallel to each other. Thus, when the corrugated steel plate is used in a short structure, the corrugated steel plate may be successfully used. However, when the corrugated steel plate is used in a long structure having a span of at least 15 m, the corrugated steel plate structure has a reduced longitudinal sectional area. Thus, the resistance of the structure against the compressive force is reduced, and thus part of the structure may be easily broken.

To solve the above mentioned problems, H-beams or ribs may be installed outside the corrugated steel plate, thus reinforcing the structure. However, to install an H-beam or a rib outside a corrugated steel plate, the H-beam or the rib is suspended over the corrugated steel plate using a crane, and workers must conduct manual work, such as bolting work, thus being excessively time-consuming and expensive. Further, because the corrugated steel plate has a reduced longitudinal sectional area, the same problem as that described above occurs.

In addition to the above?mentioned techniques, another technique has been proposed and used, in which a mold is installed along the outer surface of a corrugated steel plate structure and concrete is placed inside the mold, so that the placed concrete cures to form a reinforcement liner, which increases the sectional area of the corrugated steel plate structure and prevents partial breakage of the corrugated steel plate. However, the technique is problematic in that the mold is configured as an integrated structure in the same manner as the corrugated steel plate structure, and thus excessive time is required to produce, store, transport, and install the mold and remove the mold from a liner and, furthermore, the removed liners cannot be reused.

DISCLOSURE OF INVENTION

Technical Problem

Accordingly, the present invention has been made keeping in mind the above problems occurring in the related art, and an object of the present invention is to provide a reinforcement liner installation mold for a corrugated steel plate structure, which comprises a plurality of unit mold panels removably attached along the outer surface of a corrugated steel plate using anchor bolts and nuts, so that the period of time required to mount and remove the mold to and from the surface of the corrugated steel plate during a process of placing and curing concrete to make a reinforcement liner can be reduced, and work efficiency or the amount of work that is done can be increased, and, furthermore, the removed molds can be reused.

Technical Solution

In order to accomplish the above object, in an aspect, the present invention provides a reinforcement liner installation mold for a corrugated steel plate structure, which is mounted on one surface of a corrugated steel plate and forms a reinforcement liner when concrete is placed inside the mold and the placed concrete cures, the mold comprising: a plurality of unit mold panels 10, each comprising a rectangular front panel part 11 and two side panel parts 12 and 12' integrally formed along opposite lengthwise edges of the front panel part 11, the plurality of unit mold panels 10 being sequentially fastened to the corrugated steel plate 20 by a plurality of anchor bolts 22 and a plurality of nuts 23 along the outer surface of the corrugated steel plate 20 in a lengthwise direction.

Further, each of the unit mold panels 10 may have a curvature equal to the curvature of the corrugated steel plate 20, with a locking part 13 extending from the lower end of each of the unit mold panels 10 to a predetermined length, the locking part 13 being stepped inwards by a thickness of the front panel part 11 and a thickness of each of the side panel parts 12 and 12', so that the stepped locking part 13 is fitted into the upper end of another unit mold panel 10'.

Further, the front panel part 11 may be provided with a front through hole 14, 14', 14" at each of an upper part, a middle part and a lower part thereof along the central axis in a lengthwise direction, and each of the side panel parts 12 and 12' may be provided with a plurality of side through holes 15 and 15' at positions corresponding to centers between the front through holes 14, 14' and 14".

In addition, the reinforcement liner installation mold may further comprise: a seal 16 assembled with each of the side panel parts 12 and 12' of the unit mold panels 10 in a lengthwise direction, the seals 16 of the side panel parts 12 and 12' passing over a stepped part of the locking part 13 and being connected to each other.

Advantageous Effects

As described above, the present invention provides a reinforcement liner installation mold for a corrugated steel plate structure, which comprises a plurality of unit mold panels sequentially and longitudinally fastened to the outer surface of a corrugated steel plate structure using anchor bolts and nuts, and enables concrete mortar to be placed inside the mold and to be cured to form a reinforcement liner. Thus, the present invention reduces the period of time required to mount and remove the molds to and from the surface of a corrugated steel plate during a process of placing and curing concrete to make a reinforcement liner, increases work efficiency or the amount of work that is done, and enables the molds, after removal from the cured reinforcement liner, to be semi-permanently reused.

BEST MODE FOR CARRYING OUT THE INVENTION

Herein below, preferred embodiments of the present invention will be described in detail with reference to the accompanying drawings.

Figure 1:
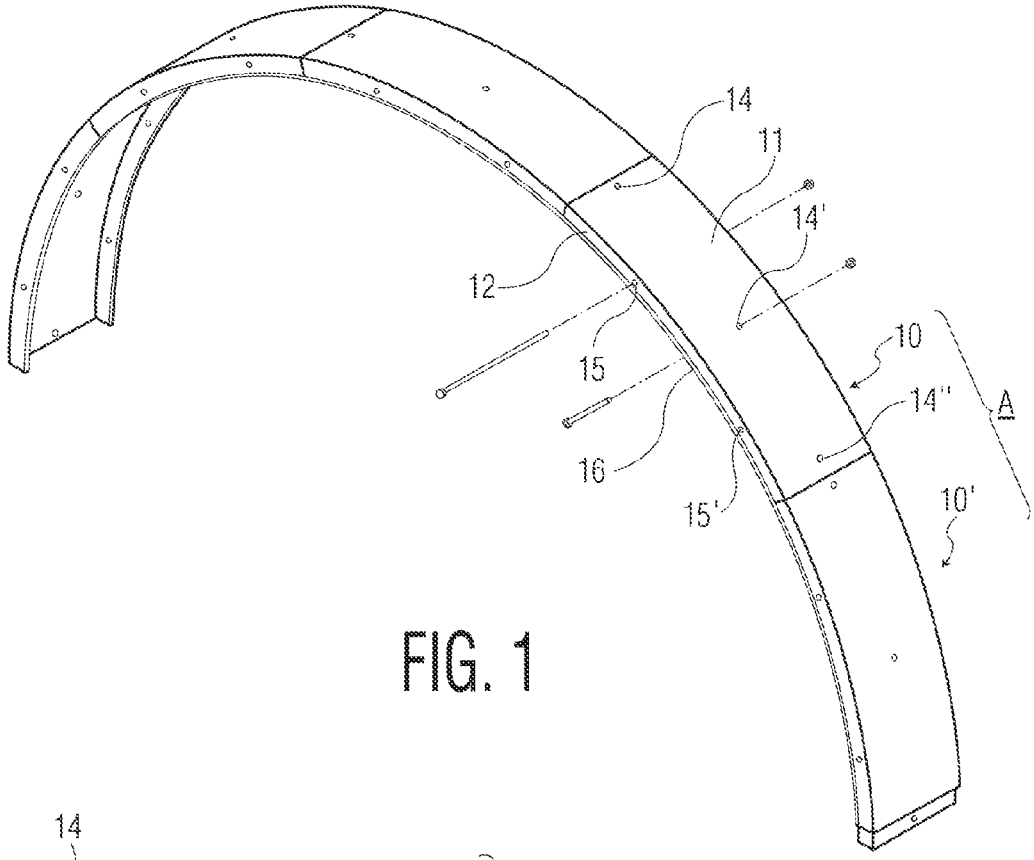
FIG. 1 is a perspective view of a reinforcement liner installation mold for a corrugated steel plate structure according to the present invention.
Figure 2:
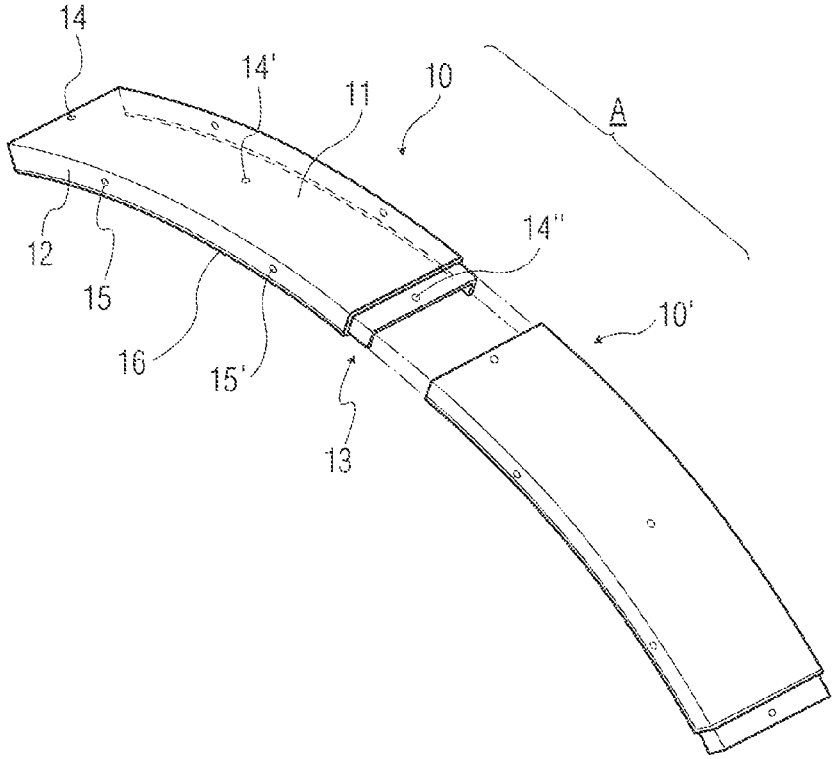
FIG. 2 is an exploded perspective view of an important part of the reinforcement liner installation mold for the corrugated steel plate structure according to the present invention.
Figure 3:
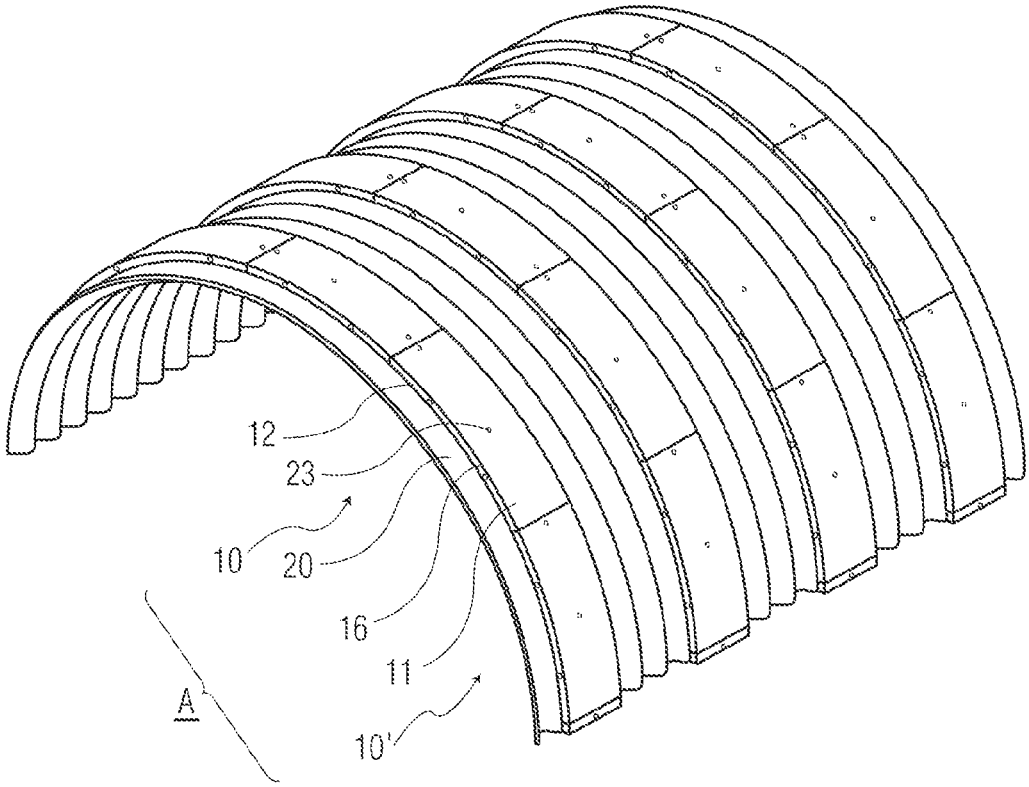
FIG. 3 is a perspective view illustrating the reinforcement liner installation mold according to the present invention, which has been installed along a corrugated steel plate structure.
Figure 4:
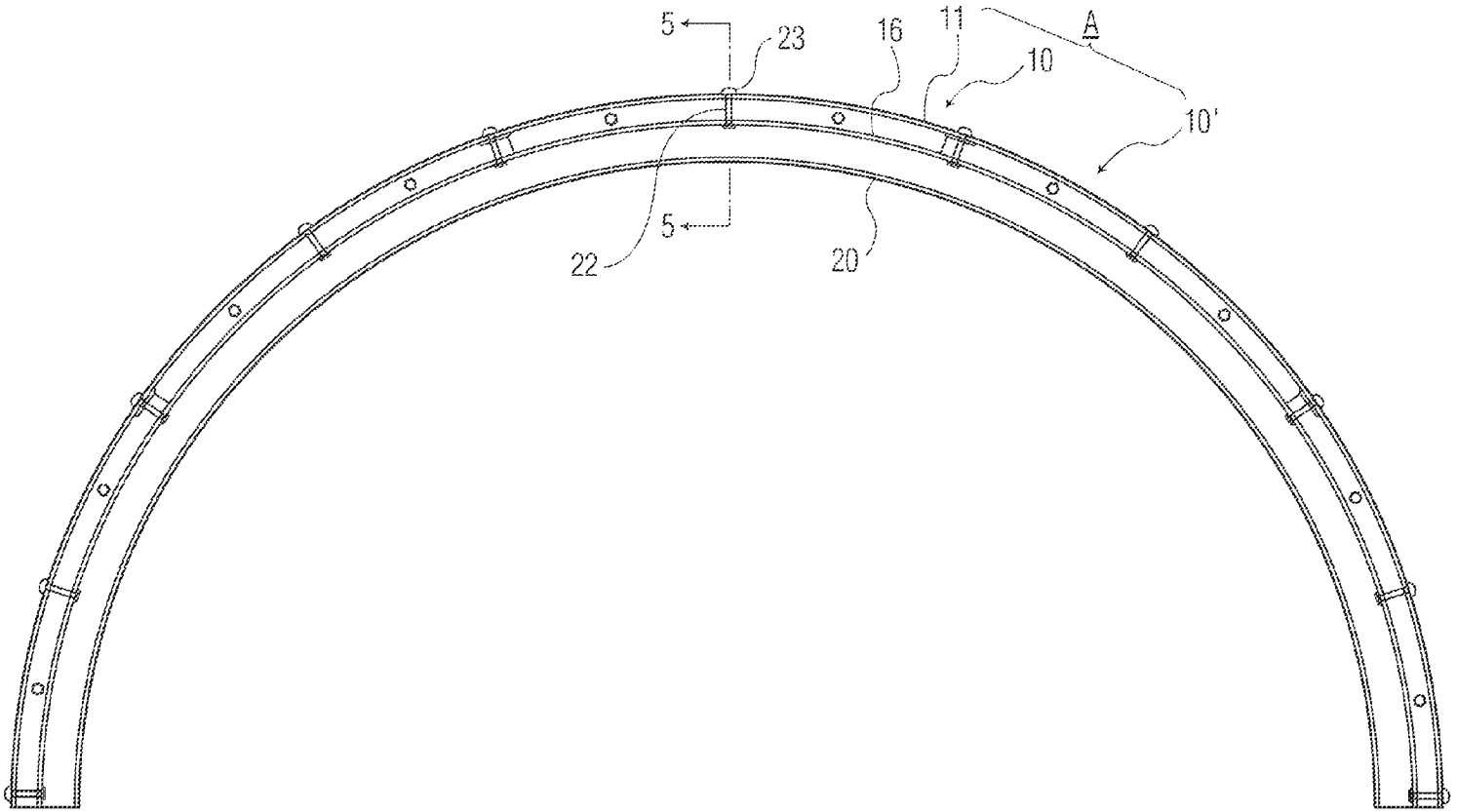
FIG. 4 is a sectional view of FIG. 3.
Figure 5:
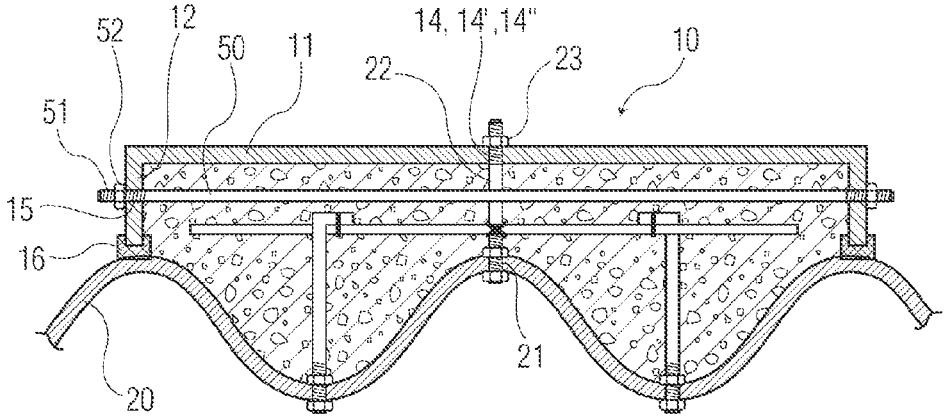
FIG. 5 is an enlarged sectional view taken along line A-A of FIG. 4.
Figure 6:
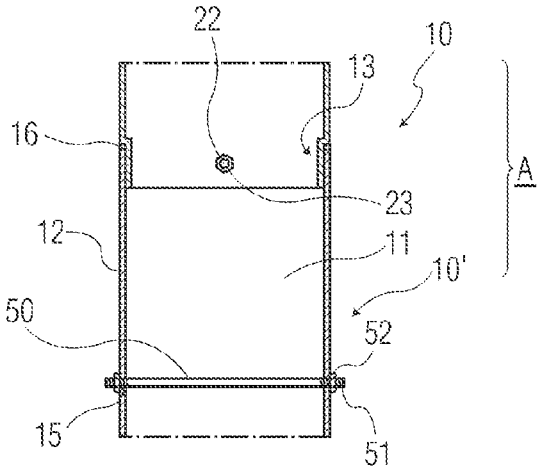
FIG. 6 is an enlarged sectional view illustrating the assembled state of a plurality of unit mold panels, which constitute the reinforcement liner installation mold for the corrugated steel plate structure according to the present invention.
Figure 7:
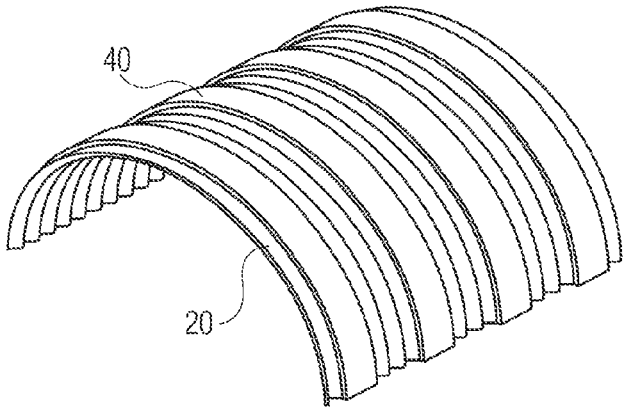
FIG. 7 is a perspective view illustrating a corrugated steel plate structure, which is provided with a reinforcement liner produced using the reinforcement liner installation mold according to the present invention.

As shown in FIG. 7, the reinforcement liner installation mold A according to the present invention comprises a plurality of unit mold panels 10, which are used for forming a reinforcement liner 40 having a predetermined width and height along the outer surface of a corrugated steel plate 20. Each of the plurality of unit mold panels 10 is open at the upper end, the lower end and the bottom side thereof, thus forming a tunnel shape having a predetermined surface area.

Each of the unit mold panels 10 is configured as a unit having a predetermined length, which is equal to the length of each section, which is one of the sections formed by equally dividing the longitudinal corrugated steel plate 20 into several pieces. The unit mold panels 10 are sequentially fastened to the outer surface of the corrugated steel plate 20 using anchor bolts 22 and nuts 23 such that the upper end of each panel 10 is fitted into a neighboring panel 10.

Each of the unit mold panels 10 comprises a rectangular front panel part 11 and two side panel parts 12, which are integrally formed along opposite lengthwise edges of the rectangular front panel part 11 such that each side panel part 12 is perpendicular to the front panel part 11 and has a predetermined width and the same length as that of the front panel part. Thus, the unit mold panels 10 are longitudinally mounted to the outer surface of the corrugated steel plate 20 using nuts 23.

Further, each of the unit mold panels 10 has a curvature equal to the curvature of the corrugated steel plate 20, so that, when the unit mold panels 10 are sequentially mounted to the outer surface of the corrugated steel plate 20 in the longitudinal direction, a constant gap can be maintained between the front panel parts 11 of the unit mold panels 10 and the outer surface of the corrugated steel plate 20. A locking part 13 having a predetermined length extends from the lower end of each unit mold panel 10, so that the unit mold panel 10 can be easily fitted into and coupled to the upper end of another unit mold panel 10'.

The locking part 13 is stepped inwards by the thickness of the front panel part 11 and the thickness of each side panel part 12, 12'. A front through hole 14", which has a predetermined diameter, is formed in the locking part 13 of each unit mold panel at a position corresponding to the front panel part 11. The front through hole 14" of a unit mold panel may be aligned with a front through hole 14 of another unit mold panel, so that the two unit mold panels can be coupled together at the aligned through holes using the anchor bolt 22 and the nut 23, thus preventing the coupled unit mold panels from being loosened at the junction thereof.

Further, to enable the unit mold panels 10 to be fastened to the outer surface of the corrugated steel plate 20 in a longitudinal direction, the front panel part 11 is provided with a front through hole 14, 14', 14" at each of the upper part, the middle part and the lower part thereof, along the central axis in a lengthwise direction. Each of the side panel parts 12 is provided with a plurality of side through holes 15 and 15' at positions corresponding to the centers between the front through holes 14, 14' and 14". Thus, a reinforcement rod 50 can be mounted to each of the unit mold panels 10, and prevents a reinforcement liner 40 from being laterally deformed by the pressure of concrete mortar which is placed inside the mold. The reinforcement rod 50 is provided with threaded parts 51 at opposite ends thereof, so that a locking nut 52 can be tightened to each threaded part 51.

Further, a seal 16 is assembled with each of the side panel parts 12 and 12' of each of the unit mold panels 10 in a lengthwise direction. The seals 16 of the two side panel parts 12 and 12' pass over the stepped part of the locking part 13 and are connected to each other to form a single body. Thus, it is possible to prevent the concrete mortar and water laden in the concrete mortar from leaking through the gap between the surface of the corrugated steel plate 20 and the unit mold panels 10.

To install the mold to form a reinforcement liner 40, the corrugated steel plate 20 is drilled at predetermined positions to form a plurality of anchor bolt insert holes 21. Thereafter, a plurality of anchor bolts 22 is inserted into the anchor bolt insert holes 21 such that part of each anchor bolt 22 protrudes from an associated one of the front through holes 14, 14' and 14" of each of the front panel parts 11.

In the above state, the locking part 13, which extends from the lower end of a unit mold panel 10, is fitted into the upper end of a previously installed unit mold panel 10' such that the front through holes 14 and 14" of the two unit mold panels 10 and 10' are aligned with each other. Thereafter, the front through holes 14 and 14" of the two unit mold panels 10 and 10' are preliminarily fastened together using a nut 23.

After a desired number of unit mold panels 10 has been installed along the outer surface of the corrugated steel plate 20 through the above mentioned process, the preliminarily tightened nuts 23 are fully tightened to the respective bolts 22 one by one. In the above state, the side panel parts 12 of the unit mold panels 10 are brought into close contact with the surface of the corrugated steel plate 20 due to the fastening force or the locking force of the bolts and nuts. Further, the seals 16, which are placed between the unit mold panels 10, are compressed and maintain watertightness.

Thereafter, a reinforcement rod 50 is inserted into the side through holes 15 and 15' of the side panel parts 12 of each unit mold panel 10 and is fastened to the unit mold panel 10 by locking nuts 52, which are tightened to the respective threaded parts 51 of the reinforcement rod 50. Thus, the installation of the mold A to the corrugated steel plate 20 is completed.

Thereafter, concrete mortar is placed inside the mold A, which has been installed on the outer surface of the corrugated steel plate 20. When the placed concrete mortar has cured, after the passage of a predetermined period of time, the mold A is removed from the cured concrete reinforcement liner. Thus, a desired corrugated steel plate structure having the reinforcement liner shown in FIG. 7 can be obtained.

The invention claimed is:

1. A reinforcement liner installation mold for a corrugated steel plate structure, which is mounted on one surface of a corrugated steel plate and forms a reinforcement liner when concrete is placed inside the mold and the placed concrete cures, the mold comprising:

a plurality of unit mold panels (10), each comprising a rectangular front panel part (11) and two side panel parts (12 and 12') integrally formed along opposite lengthwise edges of the front panel part (11), the plurality of unit mold panels (10) being sequentially fastened to the corrugated steel plate (20) by a plurality of anchor bolts (22) and a plurality of nuts (23) along the outer surface of the corrugated steel plate (20) in a lengthwise direction, the front panel part (11) is provided with a front through hole (14, 14', 14") at each of an upper part, a middle part and a lower part thereof along a central axis in a lengthwise direction, and each of the side panel parts (12 and 12') is provided with a plurality of side through holes (15 and 15') at positions corresponding to centers between the front through holes (14, 14' and 14").

2. The reinforcement liner installation mold for the corrugated steel plate structure according to claim 1, further comprising:

a seal (16) assembled with each of the side panel parts (12 and 12') of the unit mold panels (10) in a lengthwise direction, the seals (16) of the side panel parts (12 and 12') passing over a stepped part of the locking part (13) and being connected to each other.

3. A reinforcement liner installation mold for a corrugated steel plate structure, which is mounted on one surface of a corrugated steel plate and forms a reinforcement liner when concrete is placed inside the mold and the placed concrete cures, the mold comprising:

a plurality of unit mold panels (10), each comprising a rectangular front panel part (11) and two side panel parts (12 and 12') integrally formed along opposite lengthwise edges of the front panel part (11), the plurality of unit mold panels (10) being sequentially fastened to the corrugated steel plate (20) by a plurality of anchor bolts (22) and a plurality of nuts (23) along the outer surface of the corrugated steel plate (20) in a lengthwise direction, and a seal (16) assembled with each of the side panel parts (12 and 12') of the unit mold panels (10) in a lengthwise direction, the seals (16) of the side panel parts (12 and 12') passing over a stepped part of the locking part (13) and being connected to each other.

4. A reinforcement liner installation mold for a corrugated steel plate structure, which is mounted on one surface of a corrugated steel plate and forms a reinforcement liner when concrete is placed inside the mold and the placed concrete cures, the mold comprising:

a plurality of unit mold panels (10), each comprising a rectangular front panel part (11) and two side panel parts (12 and 12') integrally formed along opposite lengthwise edges of the front panel part (11), the plurality of unit mold panels (10) being sequentially fastened to the corrugated steel plate (20) by a plurality of anchor bolts (22) and a plurality of nuts (23) along the outer surface of the corrugated steel plate (20) in a lengthwise direction, wherein each of the unit mold panels (10) has a curvature equal to a curvature of the corrugated steel plate (20), with a locking part (13) extending from a lower end of each of the unit mold panels (10) to a predetermined length, the locking part (13) being stepped inwards by a thickness of the front panel part (11) and a thickness of each of the side panel parts (12 and 12'), so that the stepped locking part (13) is fitted into an upper end of another unit mold panel (10') and a seal (16) assembled with each of the side panel parts (12 and 12') of the unit mold panels (10) in a lengthwise direction, the seals (16) of the side panel parts (12 and 12') passing over a stepped part of the locking part (13) and being connected to each other.

* * * * *